US010850516B2

(12) United States Patent
Okazawa et al.

(10) Patent No.: US 10,850,516 B2
(45) Date of Patent: Dec. 1, 2020

(54) LIQUID EJECTING HEAD AND LIQUID EJECTING SYSTEM WITH A SEALING MEMBER

(71) Applicant: SEIKO EPSON CORPORATION, Tokyo (JP)

(72) Inventors: Noriaki Okazawa, Shiojiri (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/584,607

(22) Filed: Sep. 26, 2019

(65) Prior Publication Data

US 2020/0101735 A1 Apr. 2, 2020

(30) Foreign Application Priority Data

Sep. 28, 2018 (JP) ..... 2018-183624

(51) Int. Cl.
*B41J 2/14* (2006.01)

(52) U.S. Cl.
CPC ..... *B41J 2/14274* (2013.01); *B41J 2/1433* (2013.01); *B41J 2/14201* (2013.01); *B41J 2002/14241* (2013.01)

(58) Field of Classification Search
CPC ..... B41J 2/1433; B41J 2/14201; B41J 2002/14241; B41J 2002/14419; B41J 2/14274; B41J 2/045; B41J 2/01
See application file for complete search history.

(56) References Cited

U.S. PATENT DOCUMENTS

2006/0139407 A1* 6/2006 Umeda ..... B41J 2/1646 347/54
2013/0258001 A1* 10/2013 Sato ..... B41J 2/161 347/71
2014/0002556 A1* 1/2014 Sato ..... C09D 11/38 347/100

FOREIGN PATENT DOCUMENTS

JP 2000-006397 1/2000
JP 2009-137211 * 6/2009 ..... B41J 2/045

* cited by examiner

*Primary Examiner* — Henok D Legesse
(74) *Attorney, Agent, or Firm* — Workman Nydegger

(57) ABSTRACT

A head includes a first flow path forming member in which a first flow path communicating with a nozzle opening is formed, a sealing member which seals an opening of the first flow path, and a second flow path forming member which has a second flow path to supply a liquid to the first flow path. A communication portion of the first flow path communicates with a communication portion of the second flow path via a communication port of the sealing member interposed therebetween. The sealing member includes a diaphragm layer which forms one surface of the first flow path and a resin layer laminated on the diaphragm layer, and at least a part of an inside wall of the communication port is covered with a resin cover layer formed from a second resin different from a first resin which forms the resin layer.

10 Claims, 6 Drawing Sheets

LIQUID EJECTING HEAD AND LIQUID EJECTING SYSTEM WITH A SEALING MEMBER

The present application is based on, and claims priority from JP Application Serial Number 2018-183624, filed Sep. 28, 2018, the disclosure of which is hereby incorporated by reference in its entirety.

BACKGROUND

1. Technical Field

The present disclosure relates to a liquid ejecting head, such as an ink jet-type recording head, and a liquid ejecting system.

2. Related Art

As a liquid ejecting head which ejects a liquid in the form of liquid droplets from a nozzle opening by generating the change in pressure of a liquid in a pressure chamber, for example, there may be mentioned an ink jet-type recording head used for an image recording apparatus, such as a printer, a colorant ejecting head used for manufacturing of a color filter of a liquid crystal display or the like, an electrode material ejecting head used for electrode formation of an organic electro luminescence (EL) display or a face emission display (FED), or a bioorganic substance ejecting head used for manufacturing of a biochip (biochemical element).

A recording head, which is one type of liquid ejecting head, includes a continuous liquid flow path from a common ink chamber (common liquid chamber/reservoir) to a nozzle through a pressure chamber and is configured so that the change in pressure of a liquid in the pressure chamber is generated by operating a pressure generating unit, such as a piezoelectric oscillator, and by the use of this change in pressure, an ink in the pressure chamber can be ejected in the form of ink droplets from the nozzle. In the case described above, this recording head is formed by fixing, to a head case, an actuator unit (oscillator unit) which includes a piezoelectric oscillator group bonded to a fixing plate and a flow path unit which forms the above liquid flow path.

The flow path unit described above includes, for example, a metal nozzle plate in which a plurality of nozzle openings are provided in a row, a flow path forming substrate in which flow path base portions each to be used as an ink flow path, such as the pressure chamber, are formed, and a sealing plate (oscillation plate) which seals openings of the flow path base portions of this flow path forming substrate, and the flow path unit is formed by integrally laminating the members described above. The sealing plate is a composite plate member formed, for example, by laminating a resin-made elastic film (elastic membrane) on a support plate (support substrate) formed of a metal, such as stainless steel, and then partially removing the support plate, and the surface of the sealing plate at an elastic film side is bonded to the flow path forming substrate. At a portion of this sealing plate corresponding to the pressure chamber, a diaphragm portion which changes the volume of the pressure chamber is provided. This diaphragm portion is formed such that a portion of the sealing plate to which a front end surface of the piezoelectric oscillator is bonded is allowed to remain as an island portion, and the support plate around this island portion is removed by etching or the like so that the elastic film is only allowed to remain. In addition, in a portion of the sealing plate corresponding to the common ink chamber, an ink introduction hole (liquid introduction hole) to introduce an ink from a case flow path side of the head case into the common ink chamber, which is a part of the ink flow path, is provided so as to penetrate the support plate and the elastic film.

The head case is a member formed, for example, using a synthetic resin or the like to have a hollow block shape. In this head case, a receiving room which can receive the actuator unit is formed. This receiving room is continuously formed from a bottom surface of the head case functioning as a bonding surface of the flow path unit to a top surface of the head case located opposite to the bottom surface. That is, this receiving room is formed as a penetrating opening portion which penetrates the head case in a height direction thereof. In addition, in the head case, a case flow path is formed to penetrate the head case in the height direction thereof. A top end of this case flow path communicates with an ink introduction path of an introduction needle unit which includes an ink introduction needle, and a bottom end of the case flow path is formed to communicate with the ink flow path in the flow path unit through the ink introduction hole of the sealing plate. Hence, an ink introduced from the ink introduction needle is supplied to an ink flow path side through the case flow path and the ink introduction hole.

To the bottom surface of the head case having the structure described above, the flow path unit is bonded. In particular, after the diaphragm portion of the sealing plate is disposed in a bottom surface-side opening of the receiving room, in the state in which the case flow path liquid-tightly communicates with the ink flow path through the ink introduction hole, the sealing plate is bonded to the bottom surface of the head case with an adhesive or the like, so that the flow path unit is fixed to the head case. In addition, the actuator unit is inserted through a top surface-side opening of the receiving room so that a free end portion of the piezoelectric oscillator is first inserted through the opening and is received in the receiving room so as to bring the front end of the free end portion of the piezoelectric oscillator into contact with the island portion. Subsequently, while the front end of the free end portion of the piezoelectric oscillator is in contact with the island portion, the fixing plate (fixing substrate) is adhered to an inside wall surface of the receiving room, so that the actuator unit is fixed in the receiving room (see JP-A-2000-006397).

In the head in which the continuous flow path is formed by laminating the members as described above, there has been a problem in that the members themselves and/or at least one adhesive layer used for bonding the members to each other is liable to be influenced by the ink.

SUMMARY

The present disclosure was made in consideration of the situation described above and aims to provide a liquid ejecting head and a liquid ejecting system, each of which is able to prevent or reduce chemical influences of a liquid to be used.

According to one aspect of the present disclosure which solves the problem described above, there is provided a liquid ejecting head comprising: a first flow path forming member including a first flow path which has a communication portion and which communicates with a nozzle opening, a sealing member which has a communication port and which seals an opening of the first flow path, and a second flow path forming member including a second flow path which has a communication portion and which supplies a liquid to the first flow path; the first flow path forming member, the sealing member, and the second flow path forming member are sequentially laminated; and the communication portion of the first flow path communicates with the communication portion of the second flow path with the communication port of the sealing member interposed therebetween. In addition, the sealing member includes a diaphragm layer which forms one surface of the first flow path and a resin layer laminated on the diaphragm layer, and at least a part of an inside wall of the communication port is covered with a resin cover layer formed from a second resin different from a first resin which forms the resin layer.

In the liquid ejecting head described above, the sealing member may be bonded to the first flow path forming member with a resin layer formed from the same resin as the second resin.

In addition, the sealing member may be bonded to the second flow path forming member with a resin layer formed from the same resin as the second resin.

In addition, the liquid ejecting head may further comprise an actuator which displaces the diaphragm layer, and the actuator may be bonded to the diaphragm layer with a resin layer formed from the same resin as the second resin.

In addition, the communication portion of the first flow path forming member has a first opening to be coupled with the communication port, the communication portion of the second flow path forming member has a second opening to be coupled with the communication port, the first opening and the second opening each have a diameter smaller than that of the communication port so as to form a step portion between the inside wall of the communication port and an inside wall of the first opening and a step portion between the inside wall of the communication port and an inside wall of the second opening, and the resin cover layer may be provided between the step portions.

In addition, the diaphragm layer may be an aramid resin layer, and the resin layer may be formed of an epoxy resin.

In addition, the resin cover layer may be formed from an aminophenol-type epoxy resin-based adhesive.

According to another aspect of the present disclosure, there is provided a liquid ejecting system comprising: the liquid ejecting head according to the aspect described above; and an organic solvent-based ink as a liquid to be ejected from the liquid ejecting head, and the resin cover layer has a higher chemical stability against the organic solvent-based ink described above than that of the resin layer.

In the liquid ejecting system described above, for example, the organic solvent-based ink may be an ink containing at least one selected from a glycol ether, a glycol ether ester, a dibasic acid ester, an ester-based solvent, a hydrocarbon-based solvent, and an alcohol-based solvent.

In addition, according to still another aspect of the present disclosure, there is provided a liquid ejecting system comprising: the liquid ejecting head according to the aspect described above; and a photocurable ink as a liquid to be ejected from the liquid ejecting head, and the resin cover layer has a higher chemical stability against the photocurable ink than that of the resin layer.

In the liquid ejecting system described above, for example, the photocurable ink may be an ink containing as a polymerizable compound, at least one selected from a (meth)acrylate, a (meth)acrylamide, and an N-vinyl compound.

As described above, in the present disclosure, since at least a part of the inside wall of the communication port is covered with the resin cover layer formed from the second resin different from the first resin which forms the resin layer laminated on the diaphragm layer, even if the resin layer is a material liable to be chemically influenced by a liquid, when the resin layer is covered with the resin cover layer, the chemical influence by the liquid can be prevented.

DESCRIPTION OF EXEMPLARY EMBODIMENTS

Figure 1:
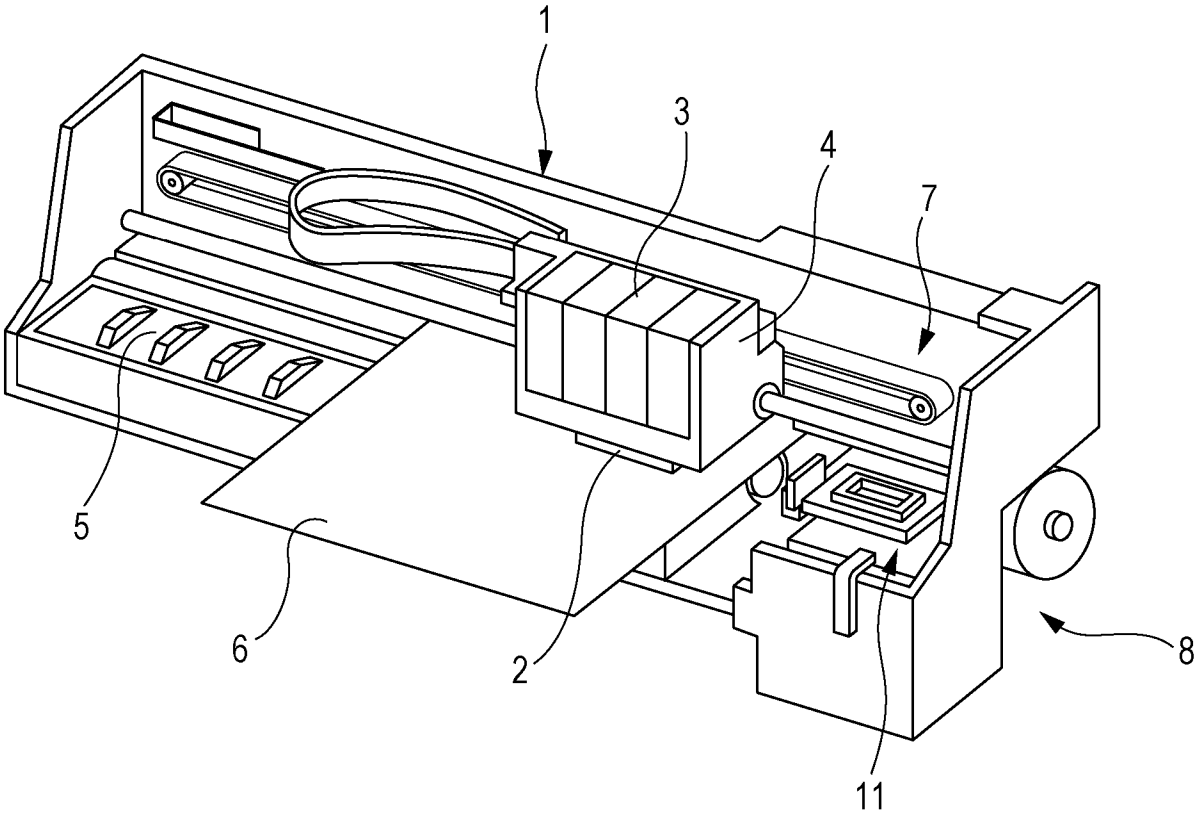
FIG. 1 is a perspective view illustrating the structure of a printer.
Figure 2:
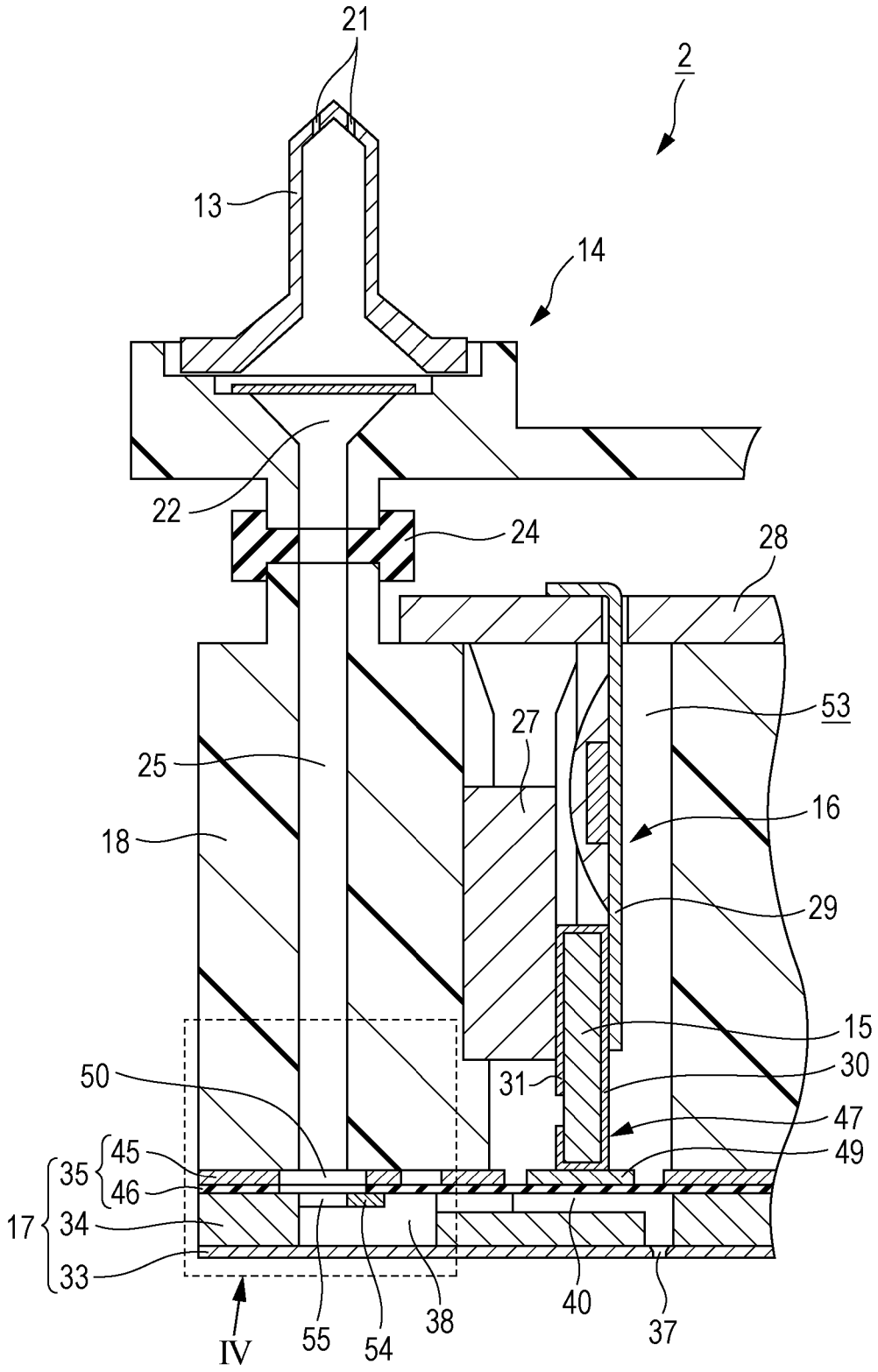
FIG. 2 is an important portion cross-sectional view illustrating the structure of a recording head.
Figure 3:
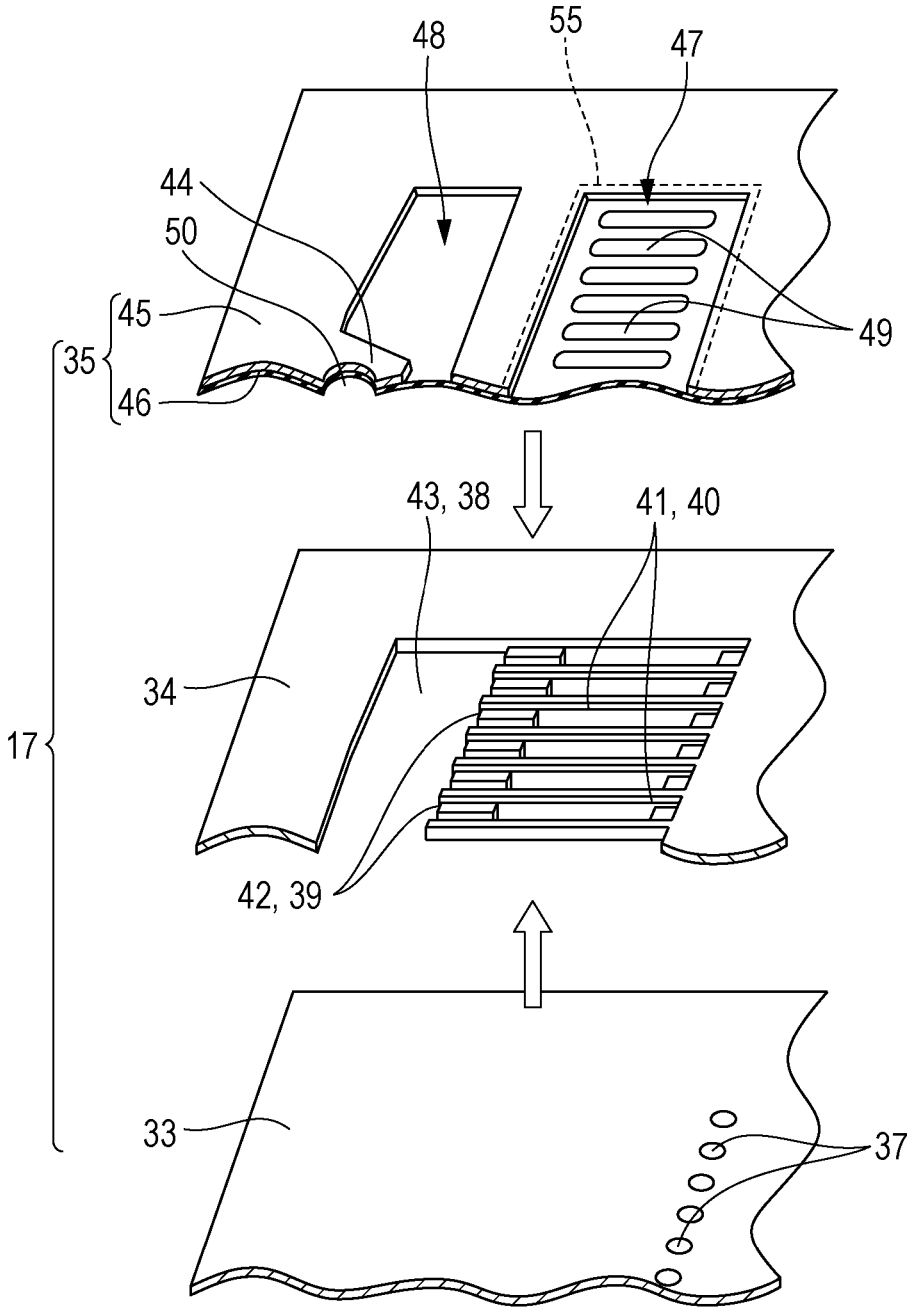
FIG. 3 is an exploded perspective view illustrating the structure of a flow path unit.
Figure 4:
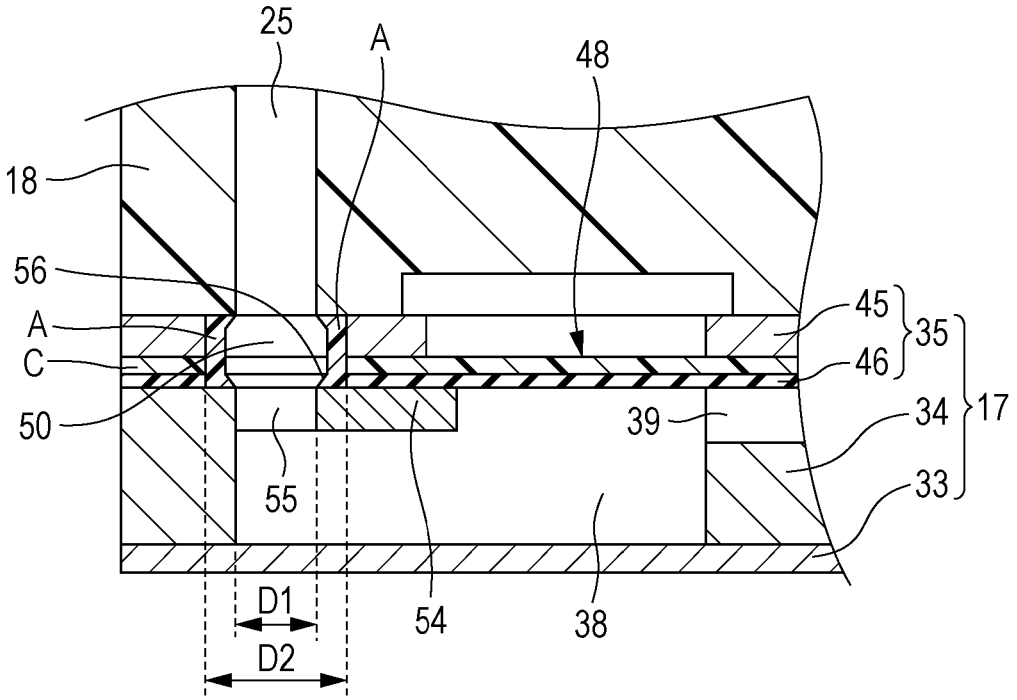
FIG. 4 is an enlarged cross-sectional view of the region IV in FIG. 2.
Figure 5:
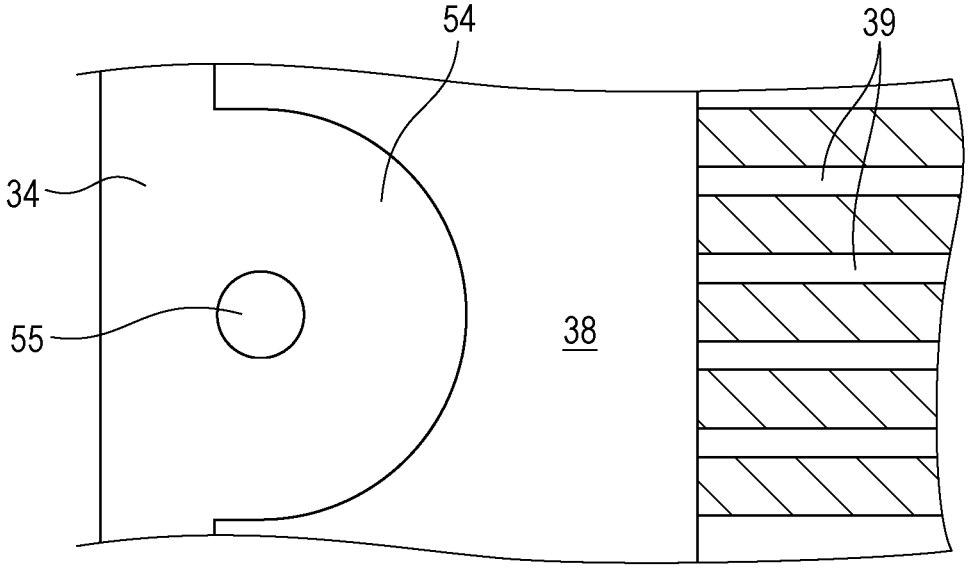
FIG. 5 is an enlarged plan view of a flow path forming member.

Hereinafter, the best mode for carrying out the present disclosure will be described with reference to the attached drawings. In addition, in the following embodiments, as preferable concrete examples of the present disclosure, although various restrictions will be described, the scope of the present disclosure is not limited thereto unless otherwise particularly described in the following description to limit the present disclosure. In addition, hereinafter, as a liquid ejecting system of the present disclosure, an ink jet-type printer (hereinafter, abbreviated as "printer") which is a liquid ejecting apparatus shown in FIG. 1 will be described by way of example. FIG. 2 is an important portion cross-sectional view illustrating the structure of a recording head 2, FIG. 3 is an exploded perspective view illustrating the structure of a flow path unit, FIG. 4 is an enlarged cross-sectional view of the region IV shown in FIG. 2, and FIG. 5 is an enlarged plan view of a flow path forming member in FIG. 4.

A printer 1 is generally formed to include, besides the recording head 2 which is one type of liquid ejecting head, a carriage 4 detachably mounting ink cartridges 3 each of which is one type of liquid storage member; a platen 5 which is disposed under the recording head 2 and which transports recording paper 6 (one type of object to be ejected); a carriage moving mechanism 7 which moves the carriage 4 in a paper width direction of the recording paper 6; a paper feed mechanism 8 which transports the recording paper 6 in a paper feed direction; and the like. In the case described above, the paper width direction indicates a main scan direction (head scan direction), and the paper feed direction indicates a sub-scan direction (that is, direction orthogonal to the head scan direction). In addition, the ink cartridge 3 is not limited to that to be fitted in the carriage 4 as in the case of this embodiment, and one type (so-called off-carriage type) which is fitted to a housing side of the printer 1 and which supplies an ink to the recording head 2 with in ink supply tube interposed therebetween may also be used.

In addition, in the moving range of the recording head 2 and outside the platen 5, a home position used as a scanning start point of the recording head 2 is provided. At this home position, a capping mechanism 11 is provided. This capping mechanism 11 seals a nozzle forming surface of the recording head 2 by a cap member and prevents vaporization of an ink solvent from a nozzle opening 37 (for example, see FIG. 2). In addition, this capping mechanism 11 is used, for example, for a cleaning operation in which a reduced pressure is applied to the nozzle surface in a sealed state to forcedly remove an ink from the nozzle opening 37 by suction.

The recording head 2 shown by way of example is generally formed to include an introduction needle unit 14 having a vertically standing ink introduction needle 13; an oscillator unit 16 (corresponding to an actuator unit) including a plurality of piezoelectric oscillators 15 each functioning as an actuator; a flow path unit 17 forming an ink flow path (one type of liquid flow path); a head case 18 in which the oscillator unit 16 is fixed and to which the flow path unit 17 is bonded; a wire substrate 28 which supplies drive signals to the piezoelectric oscillators 15; and the like.

The oscillator unit 16 is formed, for example, of piezoelectric oscillators 15 each functioning as a pressure generating element; a fixing plate 27 to which the piezoelectric oscillators 15 are bonded; and flexible cables 29 which supply drive signals from the wire substrate 28 to the piezoelectric oscillators 15. The piezoelectric oscillator 15 of this embodiment is a thin and long comb tooth-shaped laminate piezoelectric oscillator in which a piezoelectric body is sandwiched with electrodes. In addition, this piezoelectric oscillator 15 is formed as a longitudinal oscillation type piezoelectric oscillator which can be stretched in a vertical direction (longitudinal direction of the oscillator). Since a fixing end portion of the piezoelectric oscillator 15 is bonded to the fixing plate 27, the piezoelectric oscillator 15 is placed in a so-called cantilever state in which a free end portion is extended outside than a front end edge of the fixing plate 27. In addition, as described below, a front end surface of the free end portion of the piezoelectric oscillator 15 is bonded to an island portion 49 of a diaphragm portion 47 formed in a sealing plate 35.

On a surface of the piezoelectric oscillator 15 described above, a discrete external electrode 30 and a common external electrode 31 are formed. The discrete external electrode 30 is an electrode continuously formed on a front end surface portion of the piezoelectric oscillator 15 and a wire coupling surface (surface to which the flexible cable 29 is coupled) which is one side surface of the piezoelectric oscillator 15 in a lamination direction and is electrically coupled to a discrete internal electrode (not shown) in the piezoelectric oscillator 15. In addition, the common external electrode 31 is an electrode continuously formed on a base end surface portion of the piezoelectric oscillator 15 opposite to the front end surface portion and a fixing plate fitting surface which is the other side surface of the piezoelectric oscillator 15 in the lamination direction and is electrically coupled to a common internal electrode (not shown) in the piezoelectric oscillator 15. Among the external electrodes described above, the discrete external electrode 30 is electrically coupled to a discrete terminal of the flexible cable 29, and the common external electrode 31, which is the other external electrode, is electrically coupled to a common terminal (ground terminal) of the flexible cable 29. In addition, when a drive signal is applied to the piezoelectric oscillator 15 through the flexible cable 29, by the difference in potential between the discrete external electrode 30 (discrete internal electrode) and the common external electrode 31 (common internal electrode), the piezoelectric body is deformed. Accordingly, the piezoelectric oscillator 15 can be stretch-driven.

As shown in FIG. 3, the flow path unit 17 is integrally formed by bonding a nozzle plate 33, a flow path forming member 34, which is the first flow path forming member, and the sealing plate 35 (oscillation plate) functioning as a sealing member with an adhesive so that the nozzle plate 33 is disposed on one surface of the flow path forming member 34, and the sealing plate 35 is disposed on the other surface of the flow path forming member 34 at a side opposite to the nozzle plate 33. The nozzle plate 33 disposed at the lowest side in the flow path unit 17 is a stainless steel-made thin plate in which a plurality of nozzle openings 37 are formed in a row. In this embodiment, for example, 180 nozzle openings 37 are provided at a pitch corresponding to 180 dpi, and by those nozzle openings 37, the nozzle row is formed. In order to prevent noises and electrification caused by static electricity generated from recording paper and the like, this nozzle plate 33 is controlled to have a ground potential through a metal-made cover (not shown).

The flow path forming member 34 is formed, for example, from a silicon wafer and is a plate-shaped member in which flow path base portions, that is, continuous ink flow paths (one type of first flow path) each continuously formed from a common ink chamber 38, an ink supply port 39, and a pressure chamber 40, are formed. In particular, for example, a pressure chamber empty portion 41 to be used as the pressure chamber 40, a groove portion 42 to be used as the ink supply portion 39, and an empty portion (recess portion) 43 to be used as the common ink chamber 38 are formed in the flow path forming member 34 by an etching treatment. In addition, the flow path forming member may be formed by laminating a plurality of plate members in some cases.

The pressure chamber 40 is formed as a thin and long chamber orthogonal to a row direction (nozzle row direction) of the nozzle openings 37, and the ink supply port 39 is formed as a narrow portion (orifice) having a narrow flow path width to communicate between the pressure chamber 40 and the common ink chamber 38. In addition, the common ink chamber 38 is a chamber which temporarily stores an ink to be supplied from the ink introduction needle 13 through an ink introduction path 22 and a case flow path 25. The ink stored in this common ink chamber 38 is distributed and supplied to the pressure chambers 40 through the respective ink supply ports 39.

The sealing plate 35 is a composite plate having a two-layer structure formed by laminating an elastic membrane 46 which is a diaphragm layer formed from an insulating flexible film on a support substrate 45 formed from an electrically conductive plate, such as stainless steel, with a resin layer C (see FIG. 4) formed from a first resin interposed therebetween and is configured so that the surface of the sealing plate 35 at an elastic membrane 46 side is bonded to the flow path forming member 34 with an adhesive, and the surface of the sealing plate 35 at a support substrate 45 side is bonded to the bottom surface of the head case 18 with an adhesive. This sealing plate 35 is a member in which the diaphragm portion 47 which seals one opening surface of the pressure chamber 40 (pressure chamber empty portion 41) to change the volume of the pressure chamber 40 is formed and in which a compliance portion 48 which seals one opening surface of the common ink chamber 38 (recess portion 43) is formed. The diaphragm portion 47 is formed such that in order to allow a portion to which the front end surface of the piezoelectric oscillator 15 is bonded to remain as the island portion 49, the support substrate 45 therearound is removed by an etching treatment so that only the elastic membrane 46 remains. That is, this island portion 49 is independent of the other portion of the support substrate 45.

In addition, as is the plan shape of the pressure chamber 40, the shape of the island portion 49 is also a thin and long block shape orthogonal to the row direction of the nozzle openings 37.

In addition, in a portion of the sealing plate 35 which functions as the compliance portion 48, that is, in a portion corresponding to the common ink chamber 38, the support substrate 45 is removed approximately along an opening shape of the recess portion 43 of the flow path forming member 34, so that the elastic membrane 46 only remains. When this compliance portion 48 is formed, an etching treatment is performed so that a part of the support substrate 45 of the sealing plate 35 remains as an apron portion 44 protruding toward a central side from an edge portion of the compliance portion 48 (FIG. 3). In this apron portion 44, an ink introduction hole 50 (corresponding to the communication port of the present disclosure) is formed so as to penetrate the support substrate 45 and the elastic membrane 46. This ink introduction hole 50 communicates with the common ink chamber 38, which is a part of the ink flow path, when the sealing plate 35 is bonded to the flow path forming member 34 and also communicates with the case flow path 25 when the sealing plate 35 is bonded to the head case 18. That is, this ink introduction hole 50 is a penetration hole to introduce an ink flowing down from a case flow path 25 side of the head case 18 to a common ink chamber 38 side, and in this embodiment, a circular hole is formed. The dimension (inner diameter D2) of this ink introduction hole 50 is set larger that an inner diameter (inner diameter D1) of an opening of the case flow path 25 at a communication portion side (corresponding to the second opening of the communication portion of the second flow path of the second flow path forming member, the second opening communicating with the communication port). The details of this point will be described later.

The head case 18 is a synthetic resin-made hollow block member, and in the head case 18, a receiving room 53 cable of receiving the oscillator unit 16 and the case flow path 25 (corresponding to the second flow path) which supplies an ink from an introduction needle 14 side to a flow path unit 17 side are formed. The receiving room 53 of the head case 18 is continuously formed from the bottom surface of the head case 18 functioning as a surface to which the flow path unit is fitted and to the top surface of the head case 18 to which the introduction needle unit 14 and the wire substrate 28 are fitted. That is, the receiving room 53 is formed as the penetrating opening portion penetrating the head case 18 in the height direction thereof.

To the head case 18, first, the flow path unit 17 is bonded. In particular, the diaphragm portion 47 of the sealing plate 35 is disposed in a bottom opening of the receiving room 53, and in addition, in the state in which the case flow path 25 (that is, the communication portion of the second flow path) and the common ink chamber 38 (that is, the communication portion of the first flow path) liquid-tightly communicate with each other with the ink introduction hole 50 (that is, the communication port) of the sealing plate 35 interposed therebetween, the surface of the sealing plate 35 at a support substrate 45 side is adhered to the bottom surface of the head case 18 with an adhesive, so that the flow path unit 17 is bonded to the head case 18. Accordingly, the diaphragm portion 47 (island portion 49) faces the bottom surface opening of the receiving room 53 of the head case 18. Next, the oscillator unit 16 is received in the receiving room 53 of the case head 18. That is, the oscillator unit 16 is inserted through the top surface side opening of the receiving room 53 so that the free end portion of the piezoelectric oscillator 15 is first inserted through the top surface side opening and is received in the receiving room 53 so as to bring the front end of the free end portion of the piezoelectric oscillator 15 into contact with the surface of the island portion 49. In addition, since the front end of the free end portion of the piezoelectric oscillator 15 is bonded to the island portion 49 with an adhesive, and the fixing plate 27 is adhered to an inside wall surface of the receiving room 53 with an adhesive, the piezoelectric oscillator 15 is fixed in the receiving room 53.

After the flow path unit 17 and the oscillator unit 16 are fitted to the head case 18, the wire substrate 28 is arranged on the top surface of the head case 18, and wiring is performed between this wire substrate 28 and the flexible cable 29. Subsequently, on the top surface of the head case 18, the introduction needle unit 14 is fitted with a packing 24 interposed therebetween. Accordingly, the ink introduction path 22 of the introduction needle unit 14 liquid-tightly communicates with the case flow path 25 of the head case 18 with the packing 24 interposed therebetween. Hence, an ink introduced from an introduction hole 21 of the ink introduction needle 13 is supplied from the ink introduction hole 50 to an ink flow path side of the flow path unit 17, that is, to the common ink chamber 38, through the ink introduction path 22 and the case flow path 25.

In addition, in the recording head 2 having the structure described above, when a drive signal is applied to the piezoelectric oscillator 15 from the wire substrate 28 through the flexible cable 29, this piezoelectric oscillator 15 is stretched in an element longitudinal direction, and in association with this movement, the island portion 49 is transferred in a direction toward the pressure chamber 40 or in a direction apart therefrom. Accordingly, the volume of the pressure chamber 40 is changed, and the change in pressure of an ink in the pressure chamber 40 is generated. By this change in pressure, ink droplets (one type of liquid droplets) are ejected from the nozzle opening 37.

In the recording head 2 of the present disclosure, as shown in FIGS. 4 and 5, in the surface of the flow path forming member 34 to be bonded to the sealing plate 35, a cover portion 54 is formed to have a size covering the ink introduction hole 50 formed in the support substrate 45 and the elastic membrane 46; a communication portion at an ink flow path side which forms a liquid flow path with the ink introduction hole 50, that is, a communication hole 55 which is the first opening of the communication portion communicating with the common ink chamber 38, is formed in this cover portion 54; and the inner diameter D2 of the ink introduction hole 50 is set to be larger than the inner diameter D1 of each of the case flow path 25 and the communication hole 55 (in other words, the inner diameter D1 of each of the case flow path 25 and the communication hole 55 is set to be smaller than the inner diameter D2 of the ink introduction hole 50 formed in the support substrate 45 and the elastic membrane 46). Accordingly, step portions 56 are formed between the case flow path 25 and the sealing plate 35 and a resin cover layer A is formed at the step portions 56. In addition, by this resin cover layer A, the inside wall (inner circumference surface) of the ink introduction hole 50 formed in the support substrate 45 and the elastic membrane 46 is covered and hidden.

That is, by the step portion 56 formed by the difference between the diameter of the ink introduction hole 50 formed in the support substrate 45 and the elastic membrane 46 of the sealing plate 35 and the diameter of the communication hole 55 of the cover portion 54 of the flow path forming member 34, the resin cover layer A covering the inner circumference surface of the ink introduction hole 50 is prevented from flowing down, and the inner circumference surface of the ink introduction hole 50 is fully covered with the resin cover layer A. Accordingly, the resin layer C formed from the first resin which adheres the support substrate 45 to the elastic membrane 46 is not exposed to the inner circumference surface of the ink introduction hole 50 and is prevented from being brought into contact with the ink.

In addition, as shown in FIG. 5, the cover portion 54 and the communication hole 55 formed in the flow path forming member 34 are formed, for example, from a silicon wafer; and by dry etching, the cover portion 54 is formed to have a semicircular shape protruding to a common ink chamber 38 side, and in addition, the communication hole 55 is formed to have a circular shape. Accordingly, the communication hole 55 can be accurately formed, and the shape and the dimension thereof can be optimized so that when the ink is supplied to the common ink chamber 38 at a flow path unit 17 side from the case flow path 25 through the ink introduction hole 50 and the communication hole 55, for example, the pressure loss generated thereby can be suppressed.

In this case, the resin cover layer A may be formed using a second resin different from the first resin which forms the resin layer C, and a material which is not likely to receive chemical influences of an ink to be used may be used.

That is, the first resin which forms the resin layer C is selected in view of the formation of the diaphragm portion 47, and as a result, a resin selection in view of the ink resistance may not be preferentially performed in some cases. In this embodiment, the resin layer C is selected in view of the adhesiveness between the support substrate 45 formed from stainless steel or the like and the elastic membrane 46 which is a diaphragm layer formed from an insulating flexible film of a polyphenylene sulfide (PPS), an aramid resin, or the like, or in view of the formation of the diaphragm portion 47, and for example, an urethane-based adhesive or a bisphenol-type epoxy resin-based adhesive is used.

On the other hand, as the second resin to be used for the resin cover layer A, in consideration of the ink resistance, for example, when a solvent-based ink is used, a material having a high solvent resistance is selected, and when a photocurable ink is used, a material which is not likely to receive chemical influences of materials, such as solvents, used for UV curable inks is selected.

In addition, since the second resin to be used for the resin cover layer A not only fixes the area between the step portions 56 but also functions as an adhesive which bonds the sealing plate 35 to the head case 18 and the flow path forming member 34, in this embodiment, the second resin is also used as the adhesive which bonds the sealing plate 35 to the head case 18 and the flow path forming member 34. As described above, when the second resin to be used for the resin cover layer A is also used as the adhesive which bonds the sealing plate 35 to the head case 18 and the flow path forming member 34, by simply protruding the adhesive described above between the step portions 56, the resin cover layer A can be relatively easily formed. In particular, the resin cover layer A can be formed as described below.

When the head case 18 and the flow path unit 17 are bonded to each other, a sheet-shaped adhesive is transferred on a flow path unit bonding surface of the head case 18, and to this transferred portion, the surface of the flow path unit 17 at a sealing plate 35 side is adhered. In this case, as described above, since the step portion 56 is formed between the ink introduction hole 50 and the communication hole 55, as shown in FIG. 4, the adhesive partially flows to an ink introduction hole 50 side and is prevented from flowing down by the step portion 56, and the adhesive thus flowing is solidified while covering the inner circumference surface of the ink introduction hole 50, so that the adhesive thus solidified functions as the resin cover layer A.

In this embodiment, the second resin to be used for the resin cover layer A is also used as the adhesive which bonds the sealing plate 35 to the head case 18 and the flow path forming member 34, and a p-aminophenol-type epoxy resin-based adhesive different from a resin material used for the resin layer C is used as the second resin. In this case, the p-aminophenol-type epoxy resin-based adhesive is an adhesive primarily containing p-aminophenol-type epoxy resin as a resin component and also contains a curing component.

Accordingly, even when the resin layer C present between the support substrate 45 and the elastic membrane 46 of the sealing plate 35 is a material which is liable to receive chemical influences of the ink, since this resin layer C is covered with the resin cover layer A, the chemical influences of the ink on the resin layer C can be prevented or reduced, and hence, the adhesion reliability between the support substrate 45 and the elastic membrane 46 can be secured.

In addition, the resin layer C may be liable to be corroded by an organic solvent-based ink or a photocurable ink, such as an ultraviolet (UV) curable ink, in some cases. Hence, when the ink as described above is used, a resin material which is not likely to be corroded by the inks described above may be used to form the resin cover layer A, and if the resin material described above can also be used as an adhesive which bonds the sealing plate 35 to the head case 18 and the flow path forming member 34, it is more preferable. Furthermore, as an adhesive which is used to bond the front end surface of the free end portion of the piezoelectric oscillator 15 to the island portion 49 of the diaphragm portion 47 formed in the sealing plate 35, when an adhesive similar to the adhesive which bonds the sealing plate 35 to the head case 18 is used, the actuator unit can be easily disposed in the same process.

In this case, the organic solvent-based ink is an ink containing at least one of a glycol ether, a glycol ether ester, a dibasic acid ester, an ester-based solvent, a hydrocarbon-based solvent, and an alcohol-based solvent.

As the glycol ether-based solvent, for example, there may be mentioned an alkylene glycol monoether or an alkylene glycol diether.

As the alkylene glycol monoether, for example, there may be mentioned ethylene glycol monomethyl ether, ethylene glycol monoethyl ether, ethylene glycol monoisopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol monohexyl ether, diethylene glycol monobenzyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, pentaethylene glycol monomethyl ether, pentaethylene glycol monoethyl ether, pentaethylene glycol monobutyl ether, propylene glycol monomethyl ether, propylene glycol monoethyl ether, dipropylene glycol monomethyl ether, or dipropylene glycol monoethyl ether.

As the alkylene glycol diether, for example, there may be mentioned ethylene glycol dimethyl ether, ethylene glycol diethyl ether, ethylene glycol dibutyl ether, diethylene glycol dimethyl ether, diethylene glycol diethyl ether, diethylene glycol ethyl methyl ether, diethylene glycol dibutyl ether, diethylene glycol butyl methyl ether, triethylene glycol dimethyl ether, triethylene glycol diethyl ether, triethylene glycol dibutyl ether, triethylene glycol butyl methyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, or dipropylene glycol diethyl ether.

In addition, as the glycol ether ester, for example, there may be mentioned ethylene glycol monomethyl ether acetate, ethylene glycol monoethyl ether acetate, ethylene glycol monopropyl ether acetate, ethylene glycol monobutyl ether acetate, propylene glycol monomethyl ether acetate, propylene glycol monoethyl ether acetate, propylene glycol monopropyl ether acetate, propylene glycol monobutyl ether acetate, dimethylene glycol monomethyl ether acetate, dimethylene glycol monoethyl ether acetate, dimethylene glycol monopropyl ether acetate, dimethylene glycol monobutyl ether acetate, diethylene glycol monomethyl ether acetate, diethylene glycol monoethyl ether acetate, diethylene glycol monopropyl ether acetate, diethylene glycol monobutyl ether acetate, dipropylene glycol monomethyl ether acetate, dipropylene glycol monoethyl ether acetate, dipropylene glycol monopropyl ether acetate, dipropylene glycol monobutyl ether acetate, trimethylene glycol monomethyl ether acetate, trimethylene glycol monoethyl ether acetate, trimethylene glycol monopropyl ether acetate, trimethylene glycol monobutyl ether acetate, triethylene glycol monomethyl ether acetate, triethylene glycol monoethyl ether acetate, triethylene glycol monopropyl ether acetate, triethylene glycol monobutyl ether acetate, tripropylene glycol monomethyl ether acetate, tripropylene glycol monoethyl ether acetate, tripropylene glycol monopropyl ether acetate, tripropylene glycol monobutyl ether acetate, 3-methoxybutyl acetate, or 3-methoxy-3-methyl-1-butyl acetate.

As the dibasic acid ester, for example, there may be mentioned a monoester and a diester of a dicarboxylic acid (for example, an aliphatic dicarboxylic acid, such as glutaric acid, adipic acid, or succinic acid). In particular, for example, dimethyl-2-methylglutarate may be mentioned.

As the ester-based solvent, for example, there may be mentioned methyl acetate, ethyl acetate, n-propyl acetate, isopropyl acetate, n-butyl acetate, isobutyl acetate, isopentyl acetate, sec-butyl acetate, amyl acetate, methoxybutyl acetate, methyl lactate, ethyl lactate, butyl lactate, methyl caprylate, methyl laurate, isopropyl laurate, isopropyl myristate, isopropyl palmitate, isooctyl palmitate, isostearyl palmitate, methyl oleate, ethyl oleate, isopropyl oleate, butyl oleate, methyl linoleate, isobutyl linoleate, ethyl linoleate, isopropyl isostearate, methyl soybean oil ester, isobutyl soybean oil ester, methyl tall oil ester, isobutyl tall oil ester, diisopropyl adipate, diisopropyl sebacate, diethyl sebacate, propylene glycol monocaprylate, tris(2-ethylhexanoic acid) trimethylolpropane, tris(2-ethylhexanoic acid)glyceryl, ethylene glycol monomethyl ether acetate, ethylene glycol monoethyl ether acetate, propylene glycol monomethyl ether acetate, propylene glycol monoethyl ether acetate, diethylene glycol monomethyl ether acetate, diethylene glycol monoethyl ether acetate, or diethylene glycol monobutyl ether acetate.

As the hydrocarbon-based solvent, for example, there may be mentioned an aliphatic hydrocarbon (such as paraffin or isoparaffin), an alicyclic hydrocarbon (such as cyclohexane, cyclooctane, or cyclodecane), or an aromatic hydrocarbon (such as benzene, toluene, xylene, naphthalene, or tetralin). As the hydrocarbon-based solvent mentioned above, a commercially available product may also be used, and for example, there may be mentioned an aliphatic hydrocarbon or an alicyclic hydrocarbon, such as IP Solvent 1016, IP Solvent 1620, or IP Clean LX (trade name, manufactured by Idemitsu Kosan Co., Ltd.), Isopar G, Isopar L, Isopar H, Isopar M, Exxsol D40, Exxsol D80, Exxsol D100, Exxsol D130, or Exxsol D140 (trade name, manufactured by Exxon), NS Clean 100, NS Clean 110, NS Clean 200, or NS Clean 220 (trade name, manufactured by JX Nippon Oil & Energy Corporation), or Naphthesol 160, Naphthesol 200, or Naphthesol 220 (trade name, manufactured by JX Nippon Oil & Energy Corporation), or an aromatic hydrocarbon, such as Solvesso 200 (trade name, manufactured by Exxon).

As the alcohol-based solvent, for example, there may be mentioned methanol, ethanol, isopropyl alcohol, 1-propanol, 1-butanol, 2-butanol, 3-pentanol, 2-methyl-1-butanol, 2-methyl-2-butanol, isoamyl alcohol, 3-methyl-2-butanol, 3-methoxy-3-methyl-1-butanol, 4-methyl-2-pentalnol, allyl alcohol, 1-hexanol, 1-heptanol, 2-heptanol, 3-heptanol, isomyristyl alcohol, isopalmityl alcohol, isostearyl alcohol, or oleyl alcohol.

On the other hand, as the photocurable ink composition, for example, there may be mentioned an ink containing as a polymerizable compound, one of a (meth)acrylate, (meth) acrylamide, or an N-vinyl compound.

As a monofunctional (meth)acrylate, for example, there may be mentioned hexyl (meth)acrylate, 2-ethylhexyl (meth)acrylate, tert-octyl (meth)acrylate, isoamyl (meth) acrylate, decyl (meth)acrylate, isodecyl (meth)acrylate, stearyl (meth)acrylate, isostearyl (meth)acrylate, cyclohexyl (meth)acrylate, 4-n-butylcyclohexyl (meth) acrylate, bornyl (meth) acrylate, isobornyl (meth)acrylate, benzyl (meth) acrylate, 2-ethylhexyl diglycol (meth)acrylate, butoxyethyl (meth)acrylate, 2-chloroethyl (meth)acrylate, 4-bromobutyl (meth)acrylate, cyanoethyl (meth)acrylate, benzyl (meth) acrylate, butoxymethyl (meth) acrylate, 3-methoxybutyl (meth) acrylate, alkoxymethyl (meth) acrylate, alkoxyethyl (meth)acrylate, 2-(2-methoxy ethoxy)ethyl (meth)acrylate, 2-(2-butoxy ethoxy)ethyl (meth)acrylate, 2,2,2-tetrafluoroethyl (meth)acrylate, 1H,1H,2H,2H-perfluorodecyl (meth) acrylate, 4-butylphenyl (meth) acrylate, phenyl (meth)acrylate, 2,4,5-tetramethylphenyl (meth)acrylate, 4-chlorophenyl (meth) acrylate, phenoxymethyl (meth) acrylate, phenoxyethyl (meth) acrylate, glycidyl (meth) acrylate, glycidyloxybutyl (meth) acrylate, glycidyloxyethyl (meth) acrylate, glycidyloxypropyl (meth) acrylate, tetrahydrofurfuryl (meth) acrylate, hydroxyalkyl (meth)acrylate, 2-hydroxyethyl (meth)acrylate, 3-hydroxypropyl (meth) acrylate, 2-hydroxypropyl (meth)acrylate, 2-hydroxybutyl (meth)acrylate, 4-hydroxybutyl (meth) acrylate, dimethylaminoethyl (meth) acrylate, diethylaminoethyl (meth) acrylate, dimethylaminopropyl (meth) acrylate, diethylaminopropyl (meth) acrylate, trimethoxysilylpropyl (meth) acrylate, dicyclopentenyl (meth) acrylate, dicyclopentenyloxyethyl (meth) acrylate, trimethoxysilylpropyl (meth) acrylate, trimethylsilylpropyl (meth) acrylate, polyethylene oxide monomethyl ether (meth)acrylate, oligoethylene oxide monomethyl ether (meth)acrylate, polyethylene oxide (meth) acrylate, oligoethylene oxide (meth) acrylate, oligoethylene oxide monoalkyl ether (meth)acrylate, polyethylene oxide monoalkyl ether (meth)acrylate, dipropylene glycol (meth)acrylate, polypropylene oxide monoalkyl ether (meth)acrylate, oligopropylene oxide monoalkyl ether (meth) acrylate, 2-methacryloyloxyethyl succinic acid, 2-methacryloyloxy hexahydrophthalic acid, 2-methacryloyloxyethyl-2-hydroxypropyl phthalate, butoxydiethylene glycol (meth) acrylate, trifluoroethyl (meth) acrylate, perfluorooctylethyl (meth) acrylate, 2-hydroxy-3-phenoxypropyl (meth) acrylate, EO-modified phenol (meth)acrylate, EO-modified cresol (meth)acrylate, EO-modified nonylphenol (meth)acrylate, PO-modified nonylphenol (meth) acrylate, or EO-modified-2-ethylhexyl (meth) acrylate.

As the polyfunctional (meth)acrylate, for example, there may be mentioned a difunctional (meth)acrylate, such as 1,6-hexanediol di(meth)acrylate, 1,10-decanediol di(meth) acrylate, neopentyl glycol di(meth)acrylated, dipropylene glycol di(meth)acrylate (DPGD(M)A), tripropylene glycol di(meth)acrylate (TPGD(M)A), 2,4-dimethyl-1,5-pentanediol di(meth)acrylate, butyl ethyl propanediol di(meth) acrylate, ethoxylated cyclohexane methanol di(meth)acrylate, triethylene glycol di(meth)acrylate (TEGD(M)A), polyethylene glycol di(meth)acrylate, oligoethylene glycol di(meth)acrylate, ethylene glycol di(meth)acrylate, 2-ethyl-2-butyl-butanediool di(meth)acrylate, hydroxypivalic acid neopentyl glycol di(meth)acrylate, dimethylol tricyclodecane di(meth)acrylate, EO-modified bisphenol A di(meth) acrylate, bisphenol F polyethoxy di(meth)acrylate, polypropylene glycol di(meth)acrylate, oligopropylene glycol di(meth)acrylate, 1,4-buanediol di(meth)acrylate, 2-ethyl-2-butyl-propanediol di(meth)acrylate, 1,9-nonanediol di(meth)acrylate, propoxylated ethoxylated bisphenol A di(meth) acrylate, or tricyclodecane di(meth)acrylate.

Furthermore, as the polyfunctional (meth)acrylate, for example, there may be mentioned a trifunctional (meth) acrylate, such as trimethylolpropane tri(meth)acrylate, trimethylolethane tri(meth)acrylate, alkylene oxide-modified tri (meth)acrylate of trimethylolpropane, pentaerythritol tri (meth)acrylate, dipentaerythritol tri(meth)acrylate, trimethylolpropane tri(meta)acryloyloxypropyl ether, isocyanuric acid alkylene oxide-modified tri(meth)acrylate, propionic acid dipentaerythritol tri(meth)acrylate, tri((meth) acryloyloxyethyl)isocyanurate, hydroxypivalaldehyde-modified dimethylolpropane tri(meth)acrylate, sorbitol tri (meth)acrylate, propoxylated trimethylolpropane tri(meth) acrylate, or ethoxylated glycerin tri(meth)acrylate; a tetrafunctional (meth)acrylate, such as pentaerythritol tetra (meth)acrylate, sorbitol tetra(meth)acrylate, ditrimethylolpropane tetra(meth)acrylate, propionic acid dipentaerythritol tetra(meth)acrylate, or ethoxylated pentaerythritol tetra (meth)acrylate; a pentafunctional (meth)acrylate, such as sorbitol penta(meth)acrylate or dipentaerythritol penta(meth)acrylate; or a hexafunctional (meth)acrylate, such as dipentaerythritol hexa(meth)acrylate, sorbitol hexa(meth) acrylate, alkylene oxide-modified hexa(meth)acrylate of phosphazene, or a caprolactone-modified dipentaerythritol hexa(meth)acrylate.

As the (meth)acrylamide, for example, there may be mentioned (meth)acrylamide, N-methyl(meth)acrylamide, N-ethyl(meth)acrylamide, N-propyl(meth)acrylamide, N-n-butyl(meth)acrylamide, N-t-butyl(meth)acrylamide, N-butoxymethyl(meth)acrylamide, N-isopropyl(meth)acrylamide, N-methylol(meth)acrylamide, N,N-dimethyl(meth) acrylamide, N,N-diethyl(meth)acrylamide, or (meth) acryloylmorpholine.

The N-vinyl compound has a structure (>N—CH=$CH_2$) in which a vinyl group is bonded to nitrogen. As a concrete example of the N-vinyl compound, for example, there may be mentioned N-vinylformamide, N-vinylcarbazole, N-vinylindole, N-vinylpyrrole, N-vinylacetamide, N-vinylpyrrolidone, N-vinylcaprolactam, or it derivative, and among those compounds mentioned above, N-vinylcaprolactam is particularly preferable.

As a resin material excellent in chemical resistance against the organic solvent-based ink and the photocurable ink described above, an aminophenol-type epoxy resin-based adhesive, in particular, a p-aminophenol-type epoxy resin-based adhesive, may be mentioned. This material has a high chemical resistance against the organic solvent-based ink and the photocurable ink described above as compared to that of resin materials (such as an urethane resin-based adhesive and a bisphenol-type epoxy resin-based adhesive) used for the resin layer C and is preferably used as a material for the resin cover layer A.

According to the printer 1 mounting the recording head 2 formed as described above, since the chemical influences of the ink on the resin layer C can be prevented, a highly reliable ejection control can be performed. In addition, in this embodiment, since the adhesive which bonds the sealing plate 35 to the head case 18 and the flow path forming member 34 is used to form the resin cover layer A, different resin materials are not required to be individually prepared, and since the step portions 56 are formed, and the adhesive which bonds the sealing plate 35 to the head case 18 and the flow path forming member 34 is allowed to protrude between the step portions 56 to form the resin cover layer A, a step of forming the resin cover layer A is also relatively simple.

In addition, in other words, as the adhesive which bonds the sealing plate 35 to the head case 18 and the flow path forming member 34, since an adhesive having an excellent in ink resistance is used as is the case of the resin cover layer A, even when the adhesive is brought into contact with the ink, the bonding state is not influenced thereby.

Furthermore, an adhesive to be used to bond the front end surface of the free end portion of the piezoelectric oscillator 15 to the island portion 49 of the diaphragm portion 47 formed in the sealing plate 35 is preferably formed of a resin material similar to that for the resin cover layer A. In this case, in a bonding process of bonding the sealing plate 35 to the head case 18, the actuator unit can be bonded, and the process can be simplified.

Another Embodiment

The present disclosure is not limited to the embodiment described above and may be variously changed/modified based on the description of claims.

Figure 6:
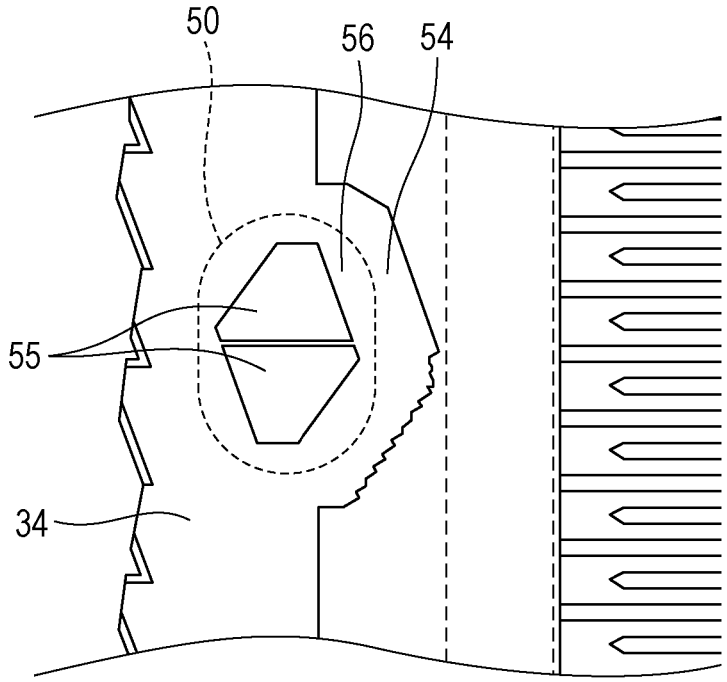
FIG. 6 is an important portion plan view illustrating the structure of a second embodiment.
Figure 7:
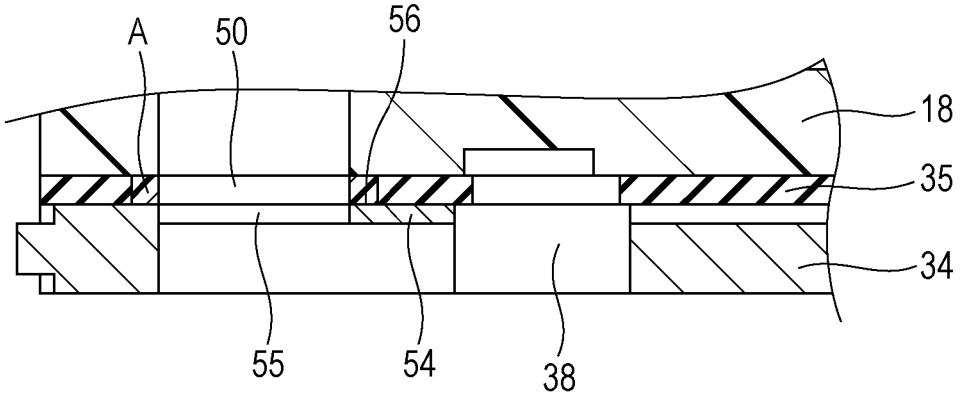
FIG. 7 is an important portion cross-sectional view illustrating the structure of the second embodiment.
Figure 8:
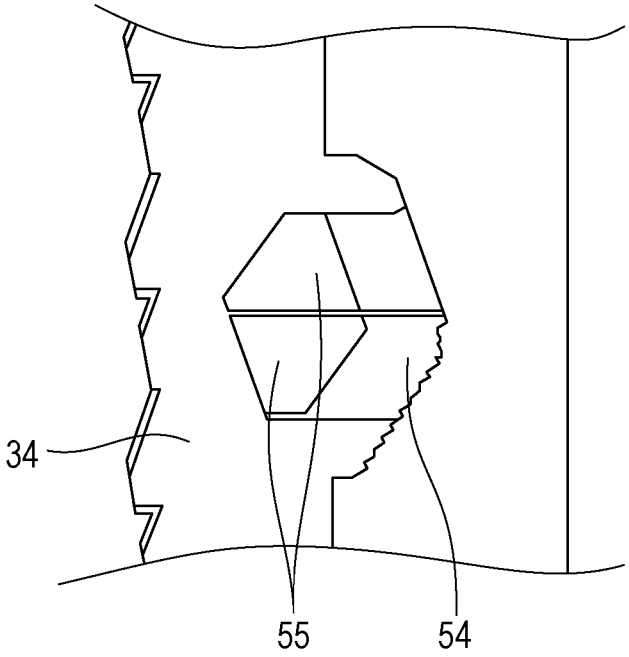
FIG. 8 is an important portion bottom plan view illustrating the structure of the second embodiment.

FIG. 6 is an important portion plan view illustrating the structure of a second embodiment of the present disclosure, FIG. 7 is an important portion cross-sectional view, and FIG. 8 is an important portion bottom plan view. In this second embodiment, as for a cover portion 54 and a communication hole 55 formed in a flow path forming member 34, by wet-etching of a silicon wafer, the cover portion 54 is formed in a polygonal shape having a saw-toothed periphery along the crystal plane so as to protrude toward a common ink chamber 38 side, and in addition, the communication hole 55 is formed in combination of two trapezoids each having a saw-toothed periphery along the crystal plane. Accordingly, when the flow path forming member 34 is formed, by adjusting the etching time, the cover portion 54 and the communication hole 55 can be easily formed simultaneously with the formation of the common ink chamber 38 and the like. In addition, by the cover portion 54 and the communication hole 55 formed by the wet etching as described above, a step portion 56 can be formed at an ink introduction hole 50, and an adhesive is allowed to stay on the step portion 56 and is prevented from extending to a bottom surface. Hence, the adhesive is prevented from being peeled off, and in addition, a sealing plate 35 is more reliably prevented from being brought into contact with an ink. The important point is that as long as the step portion 56 is formed around the periphery of the ink introduction hole 50 by the communication hole 55 of the cover portion 54, the shapes of the cover portion 54 and the communication hole 55 may be arbitrarily formed, and the formation method thereof may also be appropriately selected.

In addition, in the liquid ejecting apparatus of the embodiment described above, although the case in which the recording head 2 is supported by the carriage 4 and is transferred in a paper width direction is described by way of example, the liquid ejecting apparatus is not particularly limited thereto, and for example, the present disclosure may also be applied to a so-called line-type liquid ejecting apparatus in which the recording head 2 is fixed, and printing is performed by only transferring the recording paper 6 in a paper feed direction.

Furthermore, in the embodiment described above, as one example of the liquid ejecting system, although the liquid ejecting apparatus is described by way of example, a member formed using a recording head which is a liquid ejecting head designed to eject a desired liquid in combination with a liquid storing member which stores the desired liquid is also one type of liquid ejecting system of the present disclosure. When the member including the recording head in combination with the liquid storing member as described above is fitted to a predetermined printer main body, for example, printing can be performed, and the effect of the present disclosure described above can be obtained.

Furthermore, in the embodiment described above, although the liquid ejecting head (head unit) which ejects an ink is described as one example of the liquid ejecting head, and as one example of the liquid ejecting apparatus, the ink jet-type recording apparatus is described, the present disclosure is configured to be widely applied to the entire head units and liquid ejecting apparatuses and may also be applied, of course, to a head unit and a liquid ejecting apparatus, each of which ejects a liquid other than the ink. As the other head units, for example, there may be mentioned various head units to be used for image recording apparatuses, such as a printer; colorant ejecting head units to be used for manufacturing of color filters of liquid crystal displays and the like; electrode material ejecting head units to be used for electrode formation of organic EL displays, face emission displays (FED), and the like; and bioorganic substance ejecting head units to be used for biochip manufacturing, and the present disclosure is also applied to liquid ejecting apparatuses which use the head units described above.

What is claimed is:

1. A liquid ejecting head comprising:

a first flow path forming member including a first flow path which has a communication portion and which communicates with a nozzle opening;

a sealing member which has a communication port and which seals an opening of the first flow path; and a second flow path forming member including a second flow path which has a communication portion and which supplies a liquid to the first flow path, the first flow path forming member, the sealing member, and the second flow path forming member being sequentially laminated, wherein the communication portion of the first flow path communicates with the communication portion of the second flow path via the communication port of the sealing member interposed therebetween, wherein the sealing member includes a diaphragm layer which forms one surface of the first flow path and a resin layer laminated on the diaphragm layer, and at least a part of an inside wall of the communication port is covered with a resin cover layer formed from a second resin different from a first resin which forms the resin layer, the resin cover layer is formed from an aminophenol-type epoxy resin-based adhesive.

2. The liquid ejecting head according to claim 1, wherein the sealing member is bonded to the first flow path forming member with a resin layer formed from the same resin as the second resin.

3. The liquid ejecting head according to claim 1, wherein the sealing member is bonded to the second flow path forming member with a resin layer formed from the same resin as the second resin.

4. The liquid ejecting head according to claim 3, further comprising an actuator which displaces the diaphragm layer, wherein the actuator is bonded to the diaphragm layer with a resin layer formed from the same resin as the second resin.

5. The liquid ejecting head according to claim 1, wherein the communication portion of the first flow path forming member has a first opening to be coupled with the communication port, the communication portion of the second flow path forming member has a second opening to be coupled with the communication port, the first opening and the second opening each have a diameter smaller than that of the communication port so as to form a step portion between the inside wall of the communication port and an inside wall of the first opening and a step portion between the inside wall of the communication port and an inside wall of the second opening, and the resin cover layer is provided between the step portions.

6. The liquid ejecting head according to claim 1, wherein the diaphragm layer is an aramid resin layer, and the resin layer is formed of an epoxy resin.

7. A liquid ejecting system comprising:

the liquid ejecting head according to claim 1; and an organic solvent-based ink as a liquid to be ejected from the liquid ejecting head, wherein the resin cover layer has a higher chemical stability against the organic solvent-based ink than that of the resin layer.

8. The liquid ejecting system according to claim 7, wherein the organic solvent-based ink is an ink containing at least one selected from a glycol ether, a glycol ether ester, a dibasic acid ester, an ester-based solvent, a hydrocarbon-based solvent, and an alcohol-based solvent.

9. A liquid ejecting system comprising:

the liquid ejecting head according to claim 1; and a photocurable ink as a liquid to be ejected from the liquid ejecting head, wherein the resin cover layer has a higher chemical stability against the photocurable ink than that of the resin layer.

10. The liquid ejecting system according to claim 9, wherein the photocurable ink is an ink containing as a polymerizable compound, at least one selected from a (meth)acrylate, a (meth)acrylamide, and an N-vinyl compound.

* * * * *